US011965391B2

(12) United States Patent
Tonti et al.

(10) Patent No.: US 11,965,391 B2
(45) Date of Patent: Apr. 23, 2024

(54) DOWNHOLE TOOL WITH SEALING RING

(71) Applicant: INNOVEX DOWNHOLE SOLUTIONS, INC., Houston, TX (US)

(72) Inventors: Nick Tonti, Houston, TX (US); Carl Martin, Houston, TX (US); Justin Kellner, Adkins, TX (US)

(73) Assignee: INNOVEX DOWNHOLE SOLUTIONS, INC., Houston, TX (US)

( * ) Notice: Subject to any disclaimer, the term of this patent is extended or adjusted under 35 U.S.C. 154(b) by 157 days.

(21) Appl. No.: 17/346,530

(22) Filed: Jun. 14, 2021

(65) Prior Publication Data

US 2021/0301620 A1 Sep. 30, 2021

Related U.S. Application Data

(63) Continuation-in-part of application No. 16/695,316, filed on Nov. 26, 2019, now Pat. No. 11,136,854.

(60) Provisional application No. 62/773,507, filed on Nov. 30, 2018.

(51) Int. Cl.

| | |
|---|---|
| ***E21B 33/128*** | (2006.01) |
| ***E21B 33/12*** | (2006.01) |
| ***E21B 33/129*** | (2006.01) |

(52) U.S. Cl.

CPC ..... *E21B 33/128* (2013.01); *E21B 33/1208* (2013.01); *E21B 33/1293* (2013.01); *E21B 2200/01* (2020.05)

(58) Field of Classification Search

CPC ..... E21B 33/128; E21B 33/1208; E21B 33/1293; E21B 2200/01

See application file for complete search history.

(56) References Cited

U.S. PATENT DOCUMENTS

| | | | |
|---|---|---|---|
| 2,189,697 | A | 2/1940 | Baker |
| 2,222,233 | A | 11/1940 | Mize |
| 2,225,143 | A | 12/1940 | Baker et al. |

(Continued)

FOREIGN PATENT DOCUMENTS

| | | | |
|---|---|---|---|
| AR | 091776 | A1 | 2/2015 |
| AU | 2010214651 | A1 | 3/2012 |

(Continued)

OTHER PUBLICATIONS

Non-Final Office Action dated May 25, 2022, U.S. Appl. No. 17/178,517, 50 pages.

(Continued)

*Primary Examiner* — Dany E Akakpo

(74) *Attorney, Agent, or Firm* — MH2 TECHNOLOGY LAW GROUP, LLP

(57) ABSTRACT

An assembly includes a cone having a tapered outer surface, a slips assembly positioned at least partially around the tapered outer surface of the cone, and a sealing ring positioned at least partially around the tapered outer surface of the cone. The slips assembly directly engages the sealing ring, such that the slips assembly is configured to transmit a setting force to the sealing ring, which moves the sealing ring on the tapered outer surface of the cone and expands the sealing ring radially outward. The assembly includes an anti-seal ring positioned adjacent to the sealing ring and around the cone. The anti-seal ring is driven along the tapered outer surface of the cone by engagement with the sealing ring.

19 Claims, 7 Drawing Sheets

(56) References Cited

U.S. PATENT DOCUMENTS 2,507,270 A * 5/1950 Ragan ..... E21B 33/1265 166/120
3,127,198 A 3/1964 Orund
3,746,093 A 7/1973 Mullins
3,860,067 A 1/1975 Rodgers
4,155,404 A 5/1979 Hollingsworth
4,483,399 A 11/1984 Colgate
4,901,794 A 2/1990 Baugh et al.
5,064,164 A 11/1991 Le
5,131,468 A 7/1992 Lane et al.
5,325,923 A 7/1994 Surjaatmadja et al.
5,396,957 A 3/1995 Surjaatmadja et al.
5,479,986 A 1/1996 Gano et al.
5,542,473 A 8/1996 Pringle
5,623,993 A 4/1997 Buskirk et al.
5,701,959 A 12/1997 Hushbeck et al.
5,709,269 A 1/1998 Head
5,984,007 A 11/1999 Yuan et al.
6,167,963 B1 1/2001 McMahan et al.
6,220,349 B1 4/2001 Vargus et al.
6,296,054 B1 10/2001 Kunz et al.
6,354,372 B1 3/2002 Carisella et al.
6,354,373 B1 3/2002 Vercaemer et al.
6,446,323 B1 9/2002 Metcalfe et al.
6,581,681 B1 6/2003 Zimmerman et al.
6,662,876 B2 12/2003 Lauritzen
6,684,958 B2 2/2004 Williams et al.
6,695,050 B2 2/2004 Winslow et al.
6,702,029 B2 3/2004 Metcalfe et al.
6,712,153 B2 3/2004 Turley et al.
6,722,437 B2 4/2004 Vercaemer et al.
6,793,022 B2 9/2004 Vick et al.
6,796,376 B2 9/2004 Frazier
6,796,534 B2 9/2004 Beyer et al.
7,048,065 B2 5/2006 Badrak et al.
7,093,656 B2 8/2006 Maguire
7,096,938 B2 8/2006 Carmody et al.
7,104,322 B2 9/2006 Whanger et al.
7,150,318 B2 12/2006 Freeman
7,168,494 B2 1/2007 Starr et al.
7,168,499 B2 1/2007 Cook et al.
7,172,025 B2 2/2007 Eckerlin
7,195,073 B2 3/2007 Fraser, III
7,255,178 B2 8/2007 Slup et al.
7,273,110 B2 9/2007 Pedersen et al.
7,322,416 B2 1/2008 Burris, II et al.
7,350,582 B2 4/2008 McKeachnie et al.
7,350,588 B2 4/2008 Abercrombie Simpson et al.
7,363,967 B2 4/2008 Burris, II et al.
7,367,389 B2 5/2008 Duggan et al.
7,367,391 B1 5/2008 Stuart et al.
7,373,990 B2 5/2008 Harrall et al.
7,395,856 B2 7/2008 Murray
7,422,060 B2 9/2008 Hammami et al.
7,451,815 B2 11/2008 Hailey, Jr.
7,464,764 B2 12/2008 Xu
7,475,736 B2 1/2009 Lehr et al.
7,503,392 B2 3/2009 King et al.
7,520,335 B2 4/2009 Richard et al.
7,527,095 B2 5/2009 Bloess et al.
7,530,582 B2 5/2009 Truchsess et al.
7,552,766 B2 6/2009 Gazewood
7,562,704 B2 7/2009 Wood et al.
7,584,790 B2 9/2009 Johnson
7,603,758 B2 10/2009 Cook et al.
7,607,476 B2 10/2009 Tom et al.
7,614,448 B2 11/2009 Swagerty et al.
7,647,964 B2 1/2010 Akbar et al.
7,661,481 B2 2/2010 Todd et al.
7,665,537 B2 2/2010 Patel et al.
7,665,538 B2 2/2010 Robisson et al.
7,690,436 B2 4/2010 Turley et al.
7,757,758 B2 7/2010 O'Malley et al.
7,798,236 B2 9/2010 McKeachnie et al.
7,814,978 B2 10/2010 Steele et al.
7,832,477 B2 11/2010 Cavender et al.
7,861,744 B2 1/2011 Fly et al.
7,861,774 B2 1/2011 Fehr et al.
7,921,925 B2 4/2011 Maguire et al.
7,980,300 B2 7/2011 Roberts et al.
8,016,032 B2 9/2011 Mandrell et al.
8,047,279 B2 11/2011 Barlow et al.
8,079,413 B2 12/2011 Frazier
8,267,177 B1 9/2012 Vogel et al.
8,276,670 B2 10/2012 Patel
8,291,982 B2 10/2012 Murray et al.
8,307,892 B2 11/2012 Frazier
8,327,931 B2 12/2012 Agrawal et al.
8,336,616 B1 12/2012 McClinton
8,397,820 B2 3/2013 Fehr et al.
8,403,037 B2 3/2013 Agrawal et al.
8,425,651 B2 4/2013 Xu et al.
8,459,347 B2 6/2013 Stout
8,567,494 B2 10/2013 Rytlewski et al.
8,573,295 B2 11/2013 Johnson et al.
8,579,024 B2 11/2013 Mailand et al.
8,584,746 B2 11/2013 Marya
8,631,876 B2 1/2014 Xu et al.
8,636,074 B2 1/2014 Nutley et al.
8,684,096 B2 4/2014 Harris et al.
8,776,884 B2 7/2014 Xu et al.
8,887,818 B1 11/2014 Carr et al.
8,905,149 B2 12/2014 Bailey et al.
8,936,085 B2 1/2015 Boney et al.
8,950,504 B2 2/2015 Xu et al.
8,978,776 B2 3/2015 Spray
8,991,485 B2 3/2015 Chenault et al.
9,010,416 B2 4/2015 Xu et al.
9,016,363 B2 4/2015 Xu et al.
9,033,041 B2 5/2015 Baihly et al.
9,033,060 B2 5/2015 Xu et al.
9,057,260 B2 6/2015 Kelbie et al.
9,080,403 B2 7/2015 Xu et al.
9,080,439 B2 7/2015 O'Malley et al.
9,101,978 B2 8/2015 Xu et al.
9,206,659 B2 12/2015 Zhang et al.
9,228,404 B1 1/2016 Jackson et al.
9,309,733 B2 4/2016 Xu et al.
9,334,702 B2 5/2016 Allen et al.
9,382,790 B2 7/2016 Bertoja et al.
D762,737 S 8/2016 Fitzhugh
D763,324 S 8/2016 Fitzhugh
9,470,060 B2 10/2016 Young
9,574,415 B2 2/2017 Xu et al.
9,605,508 B2 3/2017 Xu et al.
D783,133 S 4/2017 Fitzhugh
9,752,423 B2 9/2017 Lynk
9,835,003 B2 12/2017 Harris
9,835,016 B2 12/2017 Zhang
D807,991 S 1/2018 Fitzhugh
9,909,384 B2 3/2018 Chauffe et al.
9,915,116 B2 3/2018 Jacob
9,927,058 B2 3/2018 Sue
9,976,379 B2 5/2018 Schmidt
9,976,381 B2 5/2018 Martin et al.
D827,000 S 8/2018 Van Lue
10,156,119 B2 12/2018 Martin et al.
10,400,531 B2 9/2019 Jackson et al.
10,408,012 B2 9/2019 Martin et al.
10,415,336 B2 9/2019 Benzie
10,533,392 B2 1/2020 Walton
10,605,018 B2 3/2020 Schmidt
10,648,275 B2 5/2020 Dirocco
10,920,523 B2 2/2021 Kellner et al.
2003/0062171 A1 4/2003 Maguire et al.
2003/0099506 A1 5/2003 Mosing
2003/0188876 A1 10/2003 Vick et al.
2004/0060700 A1 4/2004 Vert et al.
2004/0069485 A1 4/2004 Ringgengberg et al.
2004/0177952 A1 9/2004 Turley et al.
2004/0244968 A1 12/2004 Cook et al.
2005/0011650 A1 1/2005 Harrall et al.
2005/0139359 A1 6/2005 Maurer et al.
2005/0189103 A1 9/2005 Roberts et al.

(56) References Cited

U.S. PATENT DOCUMENTS

2005/0199401 A1 9/2005 Patel et al.
2005/0205266 A1 9/2005 Todd et al.
2005/0211446 A1 9/2005 Ricalton et al.
2005/0217866 A1 10/2005 Watson et al.
2006/0185855 A1 8/2006 Jordan et al.
2006/0272828 A1 12/2006 Manson
2007/0000664 A1 1/2007 Ring et al.
2007/0044958 A1 3/2007 Rytlewski et al.
2007/0272418 A1 11/2007 Corre et al.
2008/0066923 A1 3/2008 Xu
2008/0073074 A1 3/2008 Frazier
2008/0135248 A1 6/2008 Talley et al.
2008/0135261 A1 6/2008 McGilvray et al.
2008/0142223 A1 6/2008 Xu et al.
2008/0190600 A1 8/2008 Shkurti et al.
2008/0264627 A1 10/2008 Roberts et al.
2008/0308266 A1 12/2008 Roberts et al.
2009/0044949 A1 2/2009 King et al.
2009/0065192 A1 3/2009 Lucas
2009/0065196 A1 3/2009 Holland et al.
2009/0205843 A1 8/2009 Gandikota et al.
2009/0242213 A1 10/2009 Braddick
2009/0266560 A1 10/2009 Ring et al.
2010/0032167 A1 2/2010 Adam et al.
2010/0038072 A1 2/2010 Akselberg
2010/0116489 A1 5/2010 Nelson
2010/0132960 A1 6/2010 Shkurti et al.
2010/0170682 A1 7/2010 Brennan, III
2010/0263857 A1 10/2010 Frazier
2010/0270031 A1 10/2010 Patel
2010/0270035 A1 10/2010 Ring et al.
2010/0276159 A1 11/2010 Mailand et al.
2010/0314127 A1 12/2010 Swor et al.
2010/0319427 A1 12/2010 Lohbeck
2010/0319927 A1 12/2010 Yokley et al.
2011/0005779 A1 1/2011 Lembcke
2011/0048743 A1 3/2011 Stafford et al.
2011/0088891 A1 4/2011 Stout
2011/0132143 A1 6/2011 Xu et al.
2011/0132619 A1 6/2011 Agrawal et al.
2011/0132621 A1 6/2011 Agrawal et al.
2011/0132623 A1 6/2011 Moeller
2011/0232899 A1 9/2011 Porter
2011/0240295 A1* 10/2011 Porter ..... E21B 33/134 166/308.1
2011/0266004 A1 11/2011 Hallundbaek et al.
2011/0284232 A1 11/2011 Huang
2012/0024109 A1 2/2012 Xu et al.
2012/0055669 A1 3/2012 Levin et al.
2012/0067583 A1 3/2012 Zimmerman et al.
2012/0097384 A1 4/2012 Valencia
2012/0111566 A1 5/2012 Sherman et al.
2012/0118583 A1 5/2012 Johnson et al.
2012/0132426 A1 5/2012 Xu et al.
2012/0168163 A1 7/2012 Bertoja et al.
2012/0199341 A1 8/2012 Kellner et al.
2012/0205873 A1 8/2012 Turley
2012/0247767 A1 10/2012 Themig et al.
2012/0273199 A1 11/2012 Cresswell et al.
2013/0008671 A1 1/2013 Booth
2013/0062063 A1 3/2013 Baihly et al.
2013/0081825 A1 4/2013 Lynde et al.
2013/0186615 A1 7/2013 Hallubaek et al.
2013/0186616 A1 7/2013 Xu et al.
2013/0192853 A1 8/2013 Themig
2013/0299185 A1 11/2013 Xu et al.
2014/0014339 A1 1/2014 O'Malley et al.
2014/0076571 A1 3/2014 Frazier et al.
2014/0131054 A1 5/2014 Raynal
2014/0209325 A1 7/2014 Dockweiler
2014/0224477 A1 8/2014 Wiese
2014/0238700 A1 8/2014 Williamson
2014/0262214 A1 9/2014 Mhaskar
2014/0352970 A1 12/2014 Kristoffer
2015/0027737 A1 1/2015 Rochen
2015/0068757 A1 3/2015 Hofman et al.
2015/0075774 A1 3/2015 Raggio
2015/0129215 A1 5/2015 Xu et al.
2015/0159462 A1 6/2015 Cutler
2015/0184485 A1 7/2015 Xu et al.
2015/0218904 A1 8/2015 Chauffe et al.
2016/0160591 A1 6/2016 Xu
2016/0186511 A1 6/2016 Coronado et al.
2016/0290096 A1 10/2016 Tse
2016/0305215 A1 10/2016 Harris et al.
2016/0312557 A1 10/2016 Kitzman
2016/0333655 A1 11/2016 Fripp
2016/0369586 A1* 12/2016 Morehead ..... E21B 33/128
2016/0376869 A1 12/2016 Rochen
2017/0022781 A1 1/2017 Martin
2017/0067328 A1 3/2017 Chauffe
2017/0101843 A1 4/2017 Waterhouse et al.
2017/0130553 A1 5/2017 Harris
2017/0146177 A1 5/2017 Sue
2017/0218711 A1 8/2017 Kash
2017/0260824 A1 9/2017 Kellner
2017/0370176 A1 12/2017 Frazier
2018/0030807 A1 2/2018 Martin
2018/0073325 A1 3/2018 Dolog
2018/0087345 A1 3/2018 Xu
2018/0266205 A1 9/2018 Martin
2018/0274325 A1 9/2018 Greenlee
2018/0363409 A1 12/2018 Frazier
2019/0063179 A1 2/2019 Murphy
2019/0106961 A1 4/2019 Hardesty
2019/0203556 A1 7/2019 Powers
2019/0264513 A1 8/2019 Kosel
2019/0292874 A1 9/2019 Saeed
2020/0040680 A1* 2/2020 Mhaskar ..... E21B 23/01
2020/0072019 A1 3/2020 Tonti
2020/0080396 A1 3/2020 Subbaraman
2020/0131882 A1 4/2020 Tonti
2020/0149365 A1 5/2020 Wilson
2020/0157912 A1 5/2020 Mhaskar
2020/0173242 A1 6/2020 Kellner
2020/0173246 A1 6/2020 Kellner
2020/0248521 A1 8/2020 Southard
2020/0256150 A1 8/2020 Kellner

FOREIGN PATENT DOCUMENTS

EP 2251525 A1 11/2010
GB 2345308 A 7/2000
GB 2448449 A 10/2008
GB 2448449 B 12/2008
GB 2482078 A 1/2012
WO 2010/039131 A1 4/2010
WO 2011/023743 A2 11/2011
WO 2011/137112 A2 11/2011
WO 2014/014591 A1 1/2014
WO 2014/100072 A1 6/2014
WO 2016/160003 A1 10/2016
WO 2017/151384 A1 9/2017
WO WO-2019023493 A1 * 1/2019 ..... E21B 23/06

OTHER PUBLICATIONS

Anjum et al., Solid Expandable Tubular Combined with Swellable Elastomers Facilitate Multizonal Isolation and Fracturing, with Nothing Left in the Well Bore to Drill for Efficient Development of Tight Gas Reservoirs in Cost Effective Way, SPE International Oil & Gas Conference, Jun. 8-10, 2010, pp. 1-16.

Chakraborty et al., Drilling and Completions Services and Capabilities Presentation, Jan. 2018, Virtual Integrated Analytic Solutions, Inc., 33 pages.

Gorra et al., Expandable Zonal Isolation Barrier (ZIB) Provides a Long-Term Well Solution as a High Differential Pressure Metal Barrier to Flow, Brazilian Petroleum Technical Papers, 2010, Abstract only, 1 page.

Hinkie et al., Multizone Completion with Accurately Placed Stimulation Through Casing Wall, SPE Production and Operations Symposium, Mar. 13-Apr. 3, 2007, pp. 1-4.

(56) References Cited

OTHER PUBLICATIONS

Jackson et al., Slip Assembly, U.S. Appl. No. 13/361,477, filed Jan. 30, 2012.
Jackson et al., Slip Assembly, U.S. Appl. No. 14/987,255, filed Jan. 4, 2016.
Kellner et al., Downhole Tool Including a Swage, U.S. Appl. No. 29/689,996, filed May 3, 2019.
Kellner et al., Slip Segment for a Downhole Tool, U.S. Appl. No. 15/064,312, filed Mar. 8, 2016.
Kellner et al., Ball Drop Wireline Adapter Kit, U.S. Appl. No. 16/131,802, filed Sep. 14, 2018.
Kellner et al., Downhole Tool With Ball-in-Place Setting Assembly and Asymmetric Sleeve, U.S. Appl. No. 16/366,470, filed Mar. 27, 2019.
Kellner et al., Downhole Tool With Sleeve and Slip, U.S. Appl. No. 16/804,765, filed Feb. 28, 2020.
Kellner et al., Downhole Tool With Sealing Ring, U.S. Appl. No. 16/695,316, filed Nov. 11, 2019.
King et al., A Methodology for Selecting Interventionless Packer Setting Techniques, SPE-90678-MS, Society of Petroleum Engineers, 2004, pp. 1-3.
Larimore et al., Overcoming Completion Challenges with Interventionless Devices—Case Study—The "Disappearing Plug", SPE 63111, SPE International 2000, pp. 1-13.
Mailand et al., Non-Damaging Slips and Drillable Bridge Plug, U.S. Appl. No. 12/836,333, filed Jul. 14, 2010.
Martin et al., Downhole Tool With an Expandable Sleeve, U.S. Appl. No. 15/217,090, filed Jul. 22, 2016.
Martin et al., Downhole Tool With an Expandable Sleeve, U.S. Appl. No. 15/727,390, filed Oct. 6, 2017.
Martin et al., Downhole Tool With an Expandable Sleeve, U.S. Appl. No. 15/985,637, filed May 21, 2018.
Martin et al., Dowhnhole Tool and Methods, U.S. Appl. No. 16/818,502, filed Mar. 13, 2020.
Tonti et al., Downhole Tool With an Expandable Sleeve, Grit Material, and Button Inserts, U.S. Appl. No. 16/117,089, filed Aug. 30, 2018.
Tonti et al., Downhole Tool With Recessed Buttons, U.S. Appl. No. 16/662,792, filed Oct. 24, 2019.
Tonti, Downhole Tool With an Acid Pill, U.S. Appl. No. 17/178,517, filed Feb. 18, 2021.
Vargus et al., Completion System Allows for Interventionless Stimulation Treatments in Horizontal Wells with Multiple Shale Pay Zones, Annual SPE Technical Conference, Sep. 2008, Abstract only, 1 page.
Vargus et al., Completion System Allows for Interventionless Stimulation Treatments in Horizontal Wells with Multiple Shale Pay Zones, SPE Annual Technical Conference, Sep. 2008, pp. 1-8.
Vargus et al., System Enables Multizone Completions, The American Oil & Gas Reporter, 2009, Abstract only, 1 page.
World Oil, Slotted Liner Design for SAGD Wells ///, Jun. 2007, WorldOil.Com, https://www.worldoil.com/magazine/2007/june-2007/special-focus/slotted-liner-design-for-sagd-wells, 1 page.
Xu et al., Declaration Under 37 CFR 1.132, U.S. Appl. No. 14/605,365, filed Jan. 26, 2015, pp. 1-4.
Xu et al., Smart Nanostructured Materials Deliver High Reliability Completion Tools for Gas Shale Fracturing, SPE 146586, SPE International, 2011, pp. 1-6.
Zhang et al., High Strength Nanostructured Materials and Their Oil Field Applications, SPE 157092, SPE International, 2012, pp. 1-6.
Kellner et al., Deformable Downhole Tool With Dissolvable Element and Brittle Protective Layer, U.S. Appl. No. 16/677,993, filed Nov. 8, 2019.

* cited by examiner

DOWNHOLE TOOL WITH SEALING RING

CROSS-REFERENCE TO RELATED APPLICATIONS

This application is a continuation-in-part of U.S. patent application Ser. No. 16/695,316, filed on Nov. 26, 2019 and claiming priority to U.S. Provisional Patent Application Ser. No. 62/773,507, which was filed on Nov. 30, 2018. Each of these priority applications is incorporated herein by reference in its entirety.

BACKGROUND

Packers, bridge plugs, frac plugs, and other downhole tools may be deployed into a wellbore and set in place, e.g., to isolate two zones from one another in the wellbore. Generally, such setting is accomplished using a system of slips and seals received around a mandrel. A setting tool is used to axially compress the slips and sealing elements, and thereby radially expand them. The slips, which often have teeth, grit, buttons, or other marking structures, ride up the inclined surface of a cone during such compression, and are forced outwards into engagement with a surrounding tubular (e.g., a casing or the wellbore wall itself). This causes the slips to bite into the surrounding tubular, thereby holding the downhole tool in place. The seal is simultaneously expanded by such axial compression into engagement with the surrounding tubular, so as to isolate fluid communication axially across the tool.

The seals are typically elastomeric, and have a tendency to extrude during setting and/or when a large pressure differential across the seals is present, such as during hydraulic fracturing. In particular, the seals may extrude through a gap between circumferentially-adjacent slips, which forms when the slips are expanded radially outwards. To address this tendency, backup members are sometimes positioned axially between the slips and the seals to block these gaps and prevent extrusion. While such back-up rings are implemented with success in the field, they represent additional components and introduce failure points in the design. Accordingly, there is a need for downhole tools that avoid the drawbacks associated with rubber sealing elements.

SUMMARY

Embodiments of the disclosure include an assembly including a cone having a tapered outer surface, a slips assembly positioned at least partially around the tapered outer surface of the cone, and a sealing ring positioned at least partially around the tapered outer surface of the cone. The slips assembly directly engages the sealing ring, such that the slips assembly is configured to transmit a setting force to the sealing ring, which moves the sealing ring on the tapered outer surface of the cone and expands the sealing ring radially outward. The assembly includes an anti-seal ring positioned adjacent to the sealing ring and around the cone. The anti-seal ring is driven along the tapered outer surface of the cone by engagement with the sealing ring.

Embodiments of the disclosure also include an assembly including a setting rod, a setting sleeve positioned around the setting rod, a mandrel coupled to the setting rod and defining a seat, a cone having a tapered outer surface, positioned around the mandrel, and in axial engagement with the setting sleeve, and a slips assembly positioned around the cone. The cone advancing into the slips assembly presses the slips assembly radially outward. The assembly also includes a sealing ring positioned around the cone and in axial engagement with the slips assembly, such that advancing the cone into the slips assembly causes the slips assembly to apply an axial force to the sealing ring. Advancing the cone into the slips assembly also advances the cone axially through the sealing ring and presses the sealing ring radially outward. The assembly further includes an anti-seal ring positioned around the cone and axially adjacent to the sealing ring, such that the sealing ring is axially between the anti-seal ring and the slips assembly.

Embodiments of the disclosure further include a downhole tool including a cone having a tapered outer surface, a slips assembly positioned at least partially around the tapered outer surface of the cone, and a sealing ring positioned at least partially around the tapered outer surface of the cone. The slips assembly directly engages the sealing ring, such that the slips assembly is configured to transmit a setting force onto the sealing ring, which moves the sealing ring on the tapered outer surface of the cone and expands the sealing ring radially outward. The tool also includes a mule shoe axially engaging the sealing ring, a mandrel extending through the cone, the slips assembly, and the sealing ring and connected to the mule shoe, and an anti-seal ring positioned adjacent to the sealing ring and around the cone. The anti-seal ring is driven along the tapered outer surface of the cone by engagement with the sealing ring.

BRIEF DESCRIPTION OF THE DRAWINGS

The present disclosure may best be understood by referring to the following description and accompanying drawings that are used to illustrate embodiments of the invention. In the drawings.

DETAILED DESCRIPTION

Figure 1:
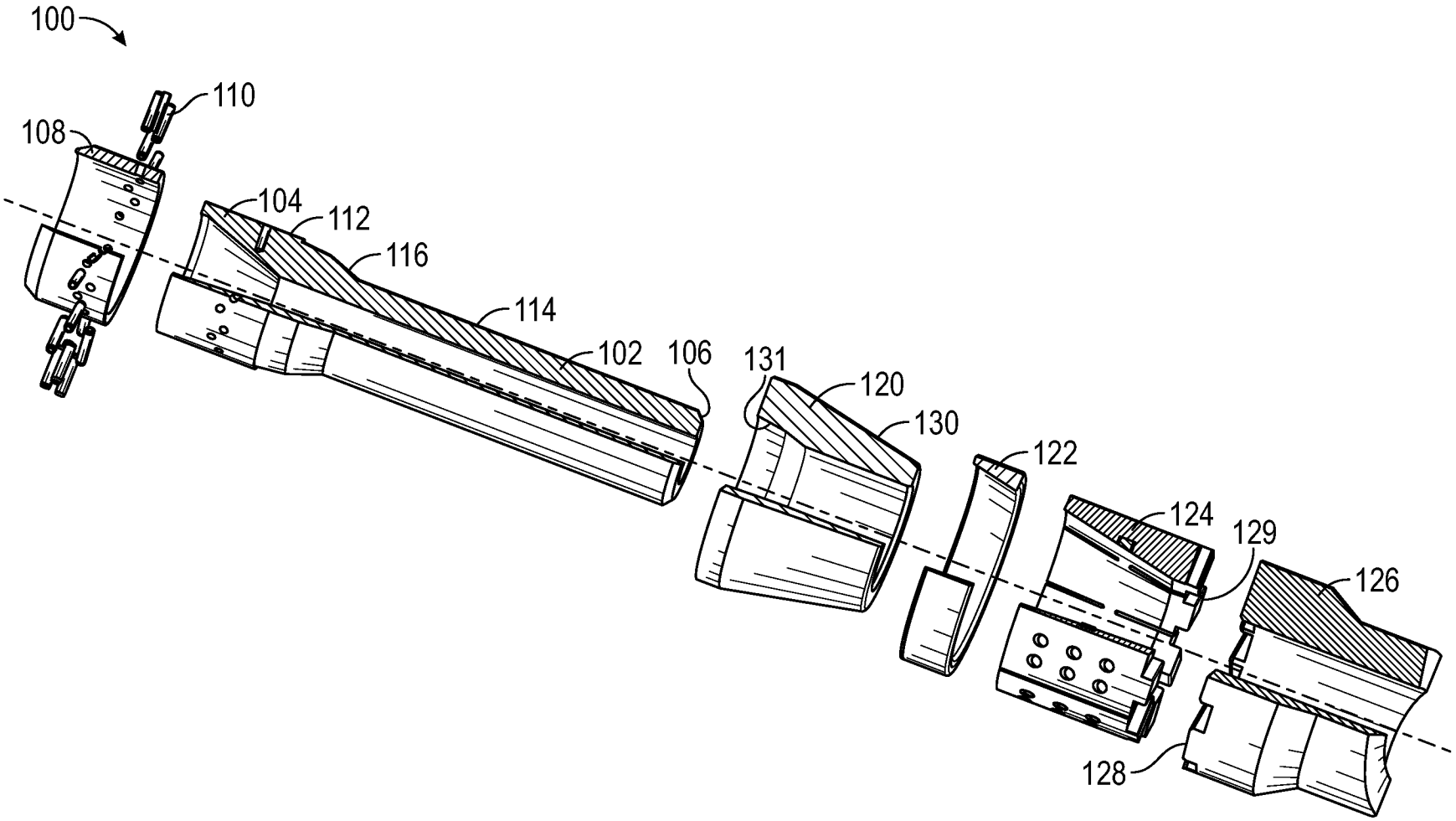
FIG. 1 illustrates an exploded, quarter-sectional view of a downhole tool, according to an embodiment.

The following disclosure describes several embodiments for implementing different features, structures, or functions of the invention. Embodiments of components, arrangements, and configurations are described below to simplify the present disclosure; however, these embodiments are provided merely as examples and are not intended to limit the scope of the invention. Additionally, the present disclosure may repeat reference characters (e.g., numerals) and/or letters in the various embodiments and across the Figures provided herein. This repetition is for the purpose of simplicity and clarity and does not in itself dictate a relationship between the various embodiments and/or configurations discussed in the Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the embodiments presented below may be combined in any combination of ways, e.g., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. In addition, unless otherwise provided herein, "or" statements are intended to be non-exclusive; for example, the statement "A or B" should be considered to mean "A, B, or both A and B."

In general, embodiments of the present disclosure may provide a downhole tool, such as a plug, that has a sealing ring. The sealing ring may be made from a material that resists extruding past the slips assembly, e.g., in contrast to elastomeric (rubber) sealing elements. The sealing ring may be positioned around a cone, and between the cone and a slips assembly of the tool. When setting the tool, the sealing ring may be expanded radially outward into engagement with a surrounding tubular. Such engagement may result in sealing the tool in the surrounding tubular, and also may apply a gripping force onto the surrounding tubular, which tends to keep the downhole tool in place relative to the surrounding tubular. The slips of the downhole tool may bear directly against the sealing ring during setting, causing the sealing ring to move axially along the cone, which results in the aforementioned expansion of the sealing ring.

Turning now to the specific, illustrated embodiments, FIG. 1 illustrates an exploded, quarter-sectional view of a downhole tool 100, according to an embodiment. The downhole tool 100 may be a packer, a bridge plug, a frac plug, or the like, without limitation. As shown, the tool 100 may generally include an inner mandrel 102 having an upper end 104 and a lower end 106. Optionally, a setting ring 108 may be attached to the upper end 104 of the mandrel 102, e.g., using shear pins 110. Additional details related to the setting ring 108 are provided in U.S. Provisional patent application Ser. No. 62/773,368, which is incorporated herein by reference, to the extent not inconsistent with the present disclosure. Various other ways to set a downhole tool by pulling upward on a mandrel, and accordingly, various other mandrel designs, are known, and in other embodiments, other types of setting arrangements/tools may be employed to this end.

The mandrel 102 may define an enlarged section 112 extending downward from the upper end 104 thereof. The mandrel 102 may also define a main section 114, which is radially smaller than the enlarged section 112. A shoulder 116 is defined at the transition between the main section 114 and the enlarged section 114. The shoulder 116 may be square or tapered. It will be appreciated that the mandrel 102 need not be a single, unitary piece, but may be two or more pieces that are coupled together.

The tool 100 may further include cone 120, a sealing ring 122, a slips assembly 124, and a mule shoe 126. Each of the cone 120, sealing ring 122, slips assembly 124, and mule shoe 126 may be received at least partially around main section 114 of the mandrel 102. The cone 120, sealing ring 122, and slips assembly 124 may be slidable on the mandrel 102, and the mule shoe 126 may be coupled (e.g., fixed) to the mandrel 102. For example, the mule shoe 126 may be threaded onto the lower end 106 of the mandrel 102. The mule shoe 126 may include upwardly-extending castellations 128, which may mesh with downwardly-extending castellations 129 of the slips assembly 124, thereby facilitating even load transmission therebetween.

The cone 120 may have a tapered outer surface 130, which extends radially outward as proceeding toward the upper end 104 of the mandrel 102. The cone 120 may also have a tapered inner surface section 131, e.g., extending to the upper end thereof, which extends radially outward as proceeding toward the upper end 104 of the mandrel 102. The tapered inner surface section 131 may extend at an angle of from about 1 degree, about 2 degrees, or about 3 degrees to about 7 degrees, about 8 degrees, or about 9 degrees. The shoulder 116 may define the same or a similar angle. Thus, the tapered inner surface section 131 and the shoulder 116 may engage along this angle. The engagement between the tapered inner surface section 131 of the cone 120 and the shoulder 116 of the mandrel 102 may prevent or at least resist the cone 120 from moving upward along the mandrel 102 during or after setting the tool 100.

Figure 2A:
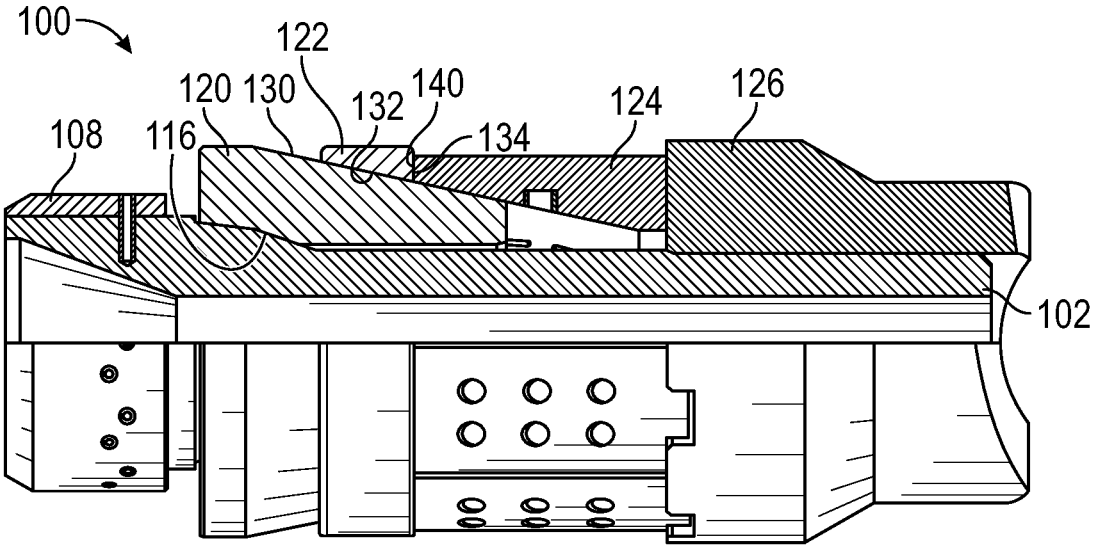
FIG. 2A illustrates a side, half-sectional view of the downhole tool in a run-in configuration, according to an embodiment.

Referring now additionally to FIG. 2A, there is shown a half-sectional, side view of the tool 100 in a run-in configuration, according to an embodiment. As is visible in FIG. 2A, the sealing ring 122 may be positioned around the tapered outer surface 130 of the cone 120. Specifically, the sealing ring 122 may have a tapered inner surface 132, which may be configured to slide along the tapered outer surface 130 of the cone 120.

The sealing ring 122 may be made from a metal, a plastic (e.g. DELRIN®) or a composite (e.g., carbon-fiber reinforced material), e.g., rather than an elastomer. As such, in normal operating conditions, the sealing ring 122 may not extrude as a rubber sealing element might upon setting. Further, the sealing ring 122 may resist deforming, at least initially, which may prevent early setting of the tool 100, e.g., during run-in, prior to the tool 100 arriving at the desired depth in the wellbore. In a specific example, the sealing ring 122 may be made from a metal. For example, the metal may be magnesium, which may be dissolvable in the wellbore. In other embodiments, the sealing ring 122 may be made from other materials.

Further, at least a portion of the slips assembly 124 may be positioned around the tapered outer surface 130 of the cone 120. An upper axial end 140 of the slips assembly 124 may engage a lower axial end 134 of the sealing ring 122. In a specific embodiment, the upper axial end 140 may contact the lower axial end 134 with nothing in between, i.e., "directly engage" the lower axial end 134.

In the run-in configuration, the sealing ring 122 may have a first average thickness, in a radial direction. As shown, this radial thickness, combined with the relative positioning of the sealing ring 122 farther up on the cone 120 than the slips assembly 124, may result in the sealing ring 122 extending farther radially outward than the slips assembly 124.

Figure 2B:
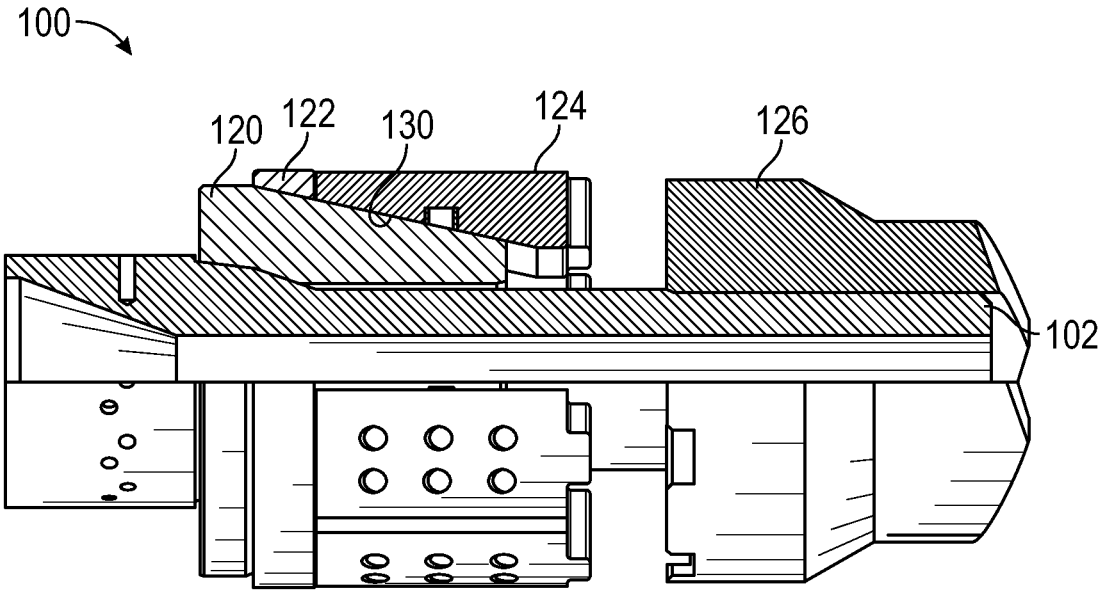
FIG. 2B illustrates a side, half-sectional view of the downhole tool in a set configuration, according to an embodiment.

When the tool 100 is deployed to a desired position within the wellbore, the tool 100 may be set in place. FIG. 2B illustrates a side, half-sectional view of the tool 100 in a set configuration, according to an embodiment.

To set the tool 100 (i.e., actuate the tool 100 from the run-in configuration of FIG. 2A to the set configuration of FIG. 2B), the mandrel 102 may be pulled in an uphole direction (to the left in the Figure), while a sleeve or another setting implement pushes in a downhole direction on the cone 120. Specifically, in this view, the tool 100 has been set, and, once set, the mule shoe 126 and the mandrel 102 have moved back to the right (downhole). It will be appreciated that the sleeve of the setting tool need not bear directly on the cone 120 during setting. For example, in some embodiments, a collar may be positioned above the cone 120, such that the setting sleeve applies force on the collar, which transmits the force to the cone 120. In other embodiments, a lock-ring housing or other ratcheting device may also or instead be positioned on the uphold side of the cone 120, and may similarly transmit forces to the cone 120.

By this combination of pushing and pulling, the mule shoe 126 is moved upward, while the cone 120 remains stationary or is moved downwards. As a consequence, the mule shoe 126 pushes the slips assembly 124 axially along the tapered outer surface 130 of the cone 120. This may expand, and in some embodiments, break the slips assembly 124 apart, such that the individual slips of the slips assembly 124 bite into the surrounding tubular (e.g., casing, liner, wellbore wall, etc.).

As this is occurring, the slips assembly 124, being pushed by the mule shoe 126, in turn pushes the sealing ring 122 up along the tapered outer surface 130 of the cone 120. This causes the annular sealing ring 122 to expand, e.g., by reducing in thickness. Eventually, the annular sealing ring 122 is pressed into engagement with the surrounding tubular, providing, e.g., a metal-to-metal or composite-to-metal seal therewith. Further, because the annular sealing ring 122 is entrained between the tapered outer surface 130 of the cone 120, the surrounding tubular, and the slips assembly 124 (as the annular sealing ring 122 may resist extruding between the slips of the slips assembly 124, unlike a rubber sealing element), the sealing ring 122 not only seals with the surrounding tubular, but may form a press-fit therewith, thereby providing an additional gripping force for the tool 100, in addition to that provided by the slips assembly 124. Moreover, back-up rings or other elements meant to prevent failure of the sealing element may be omitted, as the sealing ring 122 itself may have sufficient strength to resist undesired yielding failure. Similarly, a rubber sealing element may also be omitted.

Figure 3A:
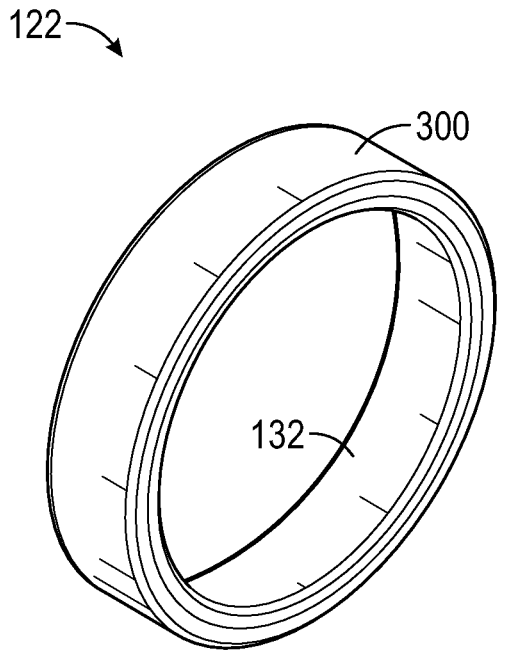
FIGS. 3A and 3B illustrate a perspective view and a side view, respectively, of an embodiment of a seal ring of the downhole tool, according to an embodiment.
Figure 3B:
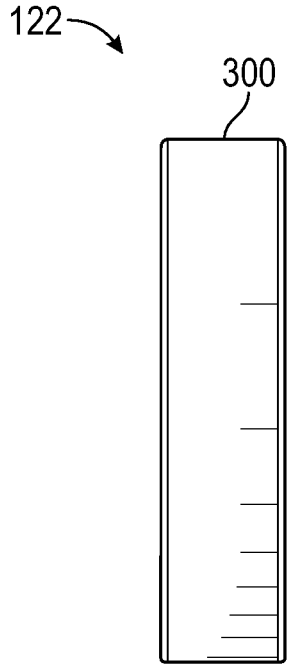

The setting ring 122 illustrated in FIGS. 1-2B is shown in greater detail in FIGS. 3A and 3B. As shown, the setting ring 122 is generally solid and wedge-shaped in cross-section, having the aforementioned tapered inner surface 132, and an outer surface 300 having a generally constant diameter.

Figure 4A:
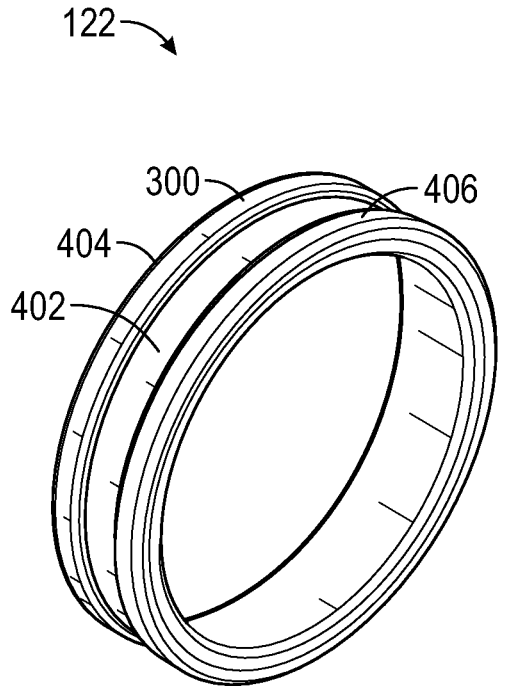
FIGS. 4A and 4B illustrate a perspective view and a side view, respectively, of another embodiment of the seal ring.
Figure 4B:
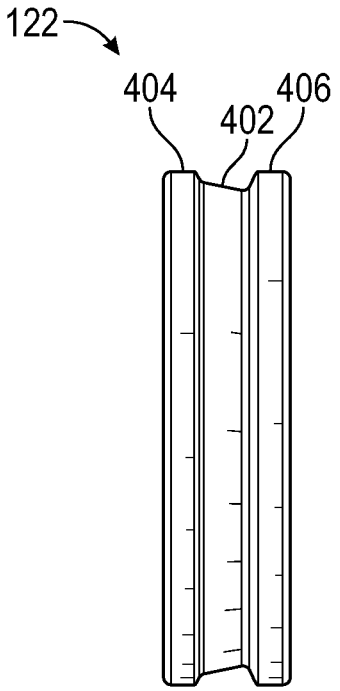

FIGS. 4A and 4B illustrate a perspective view and a side view, respectively, of another embodiment of the sealing ring 122. As shown, the outer surface 300 thereof may define a recessed center section 402 axially between two peaks 404, 406. Providing such a recessed center section 402 may reduce the force required to expand the sealing ring 122 during setting, e.g., by driving the sealing ring 122 up the tapered outer surface 130 of the cone 120, as mentioned above. Furthermore, as the sealing ring 122 is pressed against the surrounding tubular, the cross-section of the sealing ring 122 may change as the peaks 404, 406 deform and are reduced and the center section 402 increases in diameter to meet the surrounding tubular, thereby providing increased surface area contact with the surrounding tubular. It will be appreciated that multiple such recessed sections, and three or more peaks, may be provided, without departing from the disclosure.

Figure 5A:
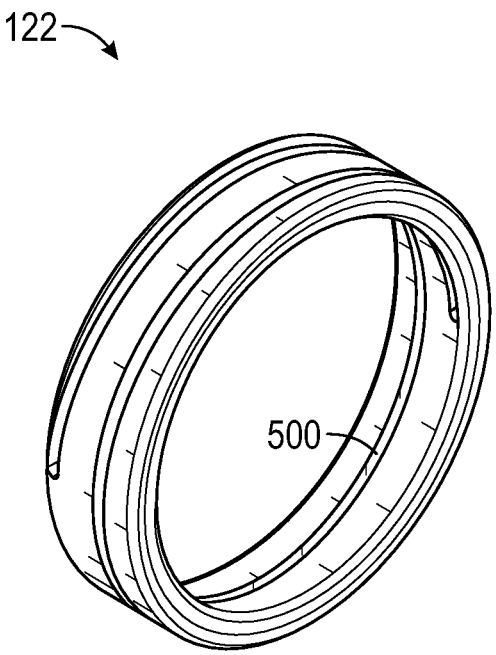
FIGS. 5A and 5B illustrate a perspective view and a side view, respectively, of another embodiment of the seal ring.
Figure 5B:
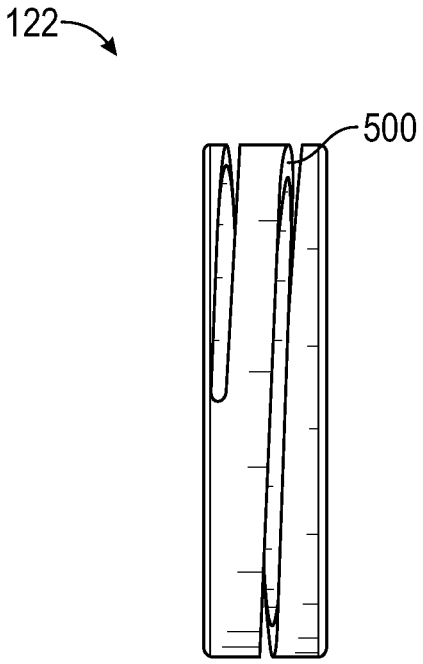

FIGS. 5A and 5B illustrate a perspective view and a side view, respectively, of yet another embodiment of the sealing ring 122. In this embodiment, the sealing ring 122 is helical. This helical shape may be formed by winding a material, e.g., as with a spring, or by cutting a slot helically into a tubular blank, e.g., entirely radially through the blank. In either such example, a helical gap 500 may be formed, which, in some embodiments, extends entirely through the radial dimension of the sealing ring 122. This embodiment may also serve to reduce the setting force required to expand the sealing ring 122, as compared to the embodiment of FIGS. 3A and 3B. In particular, as the tool 100 is set and the sealing ring 122 is driven up the tapered outer surface 130 of the cone 120, the sealing ring 122 partially unwinds, and thus expands by bending rather than by (or in addition to) forcing the thickness thereof to change.

Figure 6A:
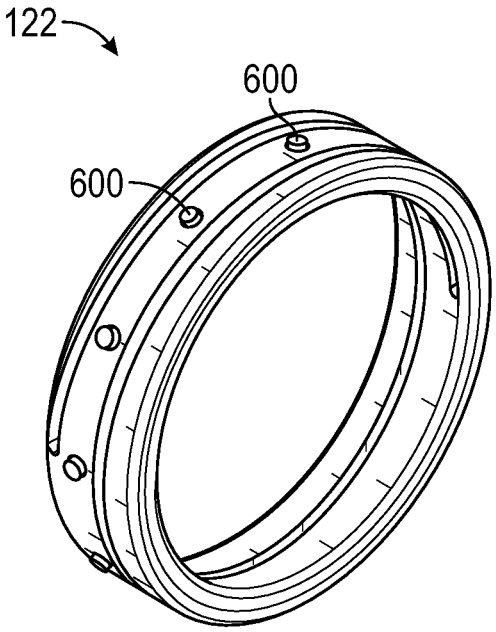
FIGS. 6A and 6B illustrate a perspective view and a side view, respectively, of another embodiment of the seal ring.
Figure 6B:
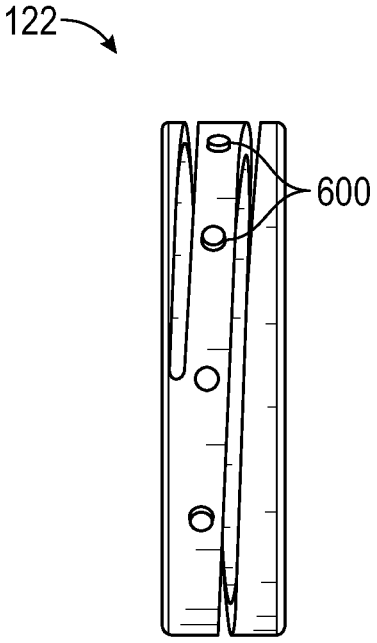

FIGS. 6A and 6B illustrate a side view and a perspective view, respectively, of still another embodiment of the sealing ring 122. In this embodiment, the sealing ring 122 is again helical, and operates to expand in generally the same way as the embodiment of FIGS. 5A and 5B. However, in this embodiment, the sealing ring 122 is additionally provided with inserts 600, which are sometimes referred to as "buttons." Such inserts 600 may be formed from material that is harder than the material of the sealing ring 122, e.g., carbide or ceramic. The inserts 600 may thus bite (e.g., partially embed) into the surrounding tubular when the tool 100 is set. The inserts 600 may be oriented to resist displacement of the sealing ring 122 toward the lower end of the mandrel 102 during flow-back operations. That is, the inserts 600 may resist the sealing ring 122 losing gripping force and being displaced from engagement with the surrounding tubular when the pressure differential across the tool 100 reverses (from high above, low below, to high below, low above). It will be appreciated that the inserts 600 may be added to any of the sealing ring 122 embodiments disclosed herein, and their addition to the helical embodiment is merely an example.

Figure 7:
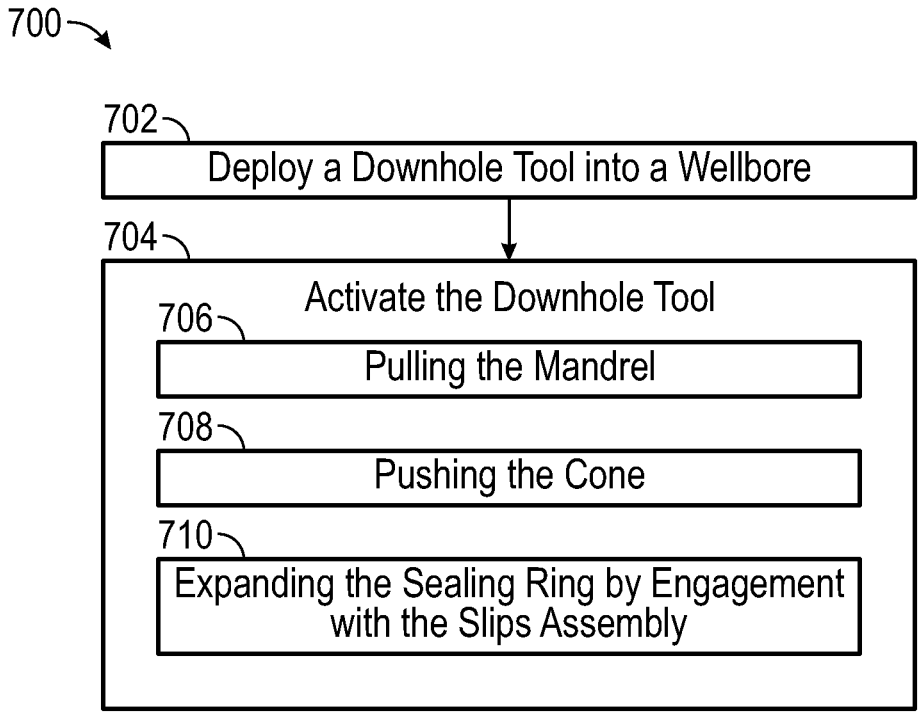
FIG. 7 illustrates a flowchart of a method for setting a downhole tool, according to an embodiment.

FIG. 7 illustrates a flowchart of a method 700 for plugging a wellbore, according to an embodiment. The method 700 may proceed by operation of an embodiment of the downhole tool 100, and is thus described herein, for convenience, with reference thereto. However, it will be appreciated that the method 700 may proceed by operation of other downhole tools, and is thus not to be considered limited to any particular structure unless otherwise specified herein.

The method 700 may include deploying a downhole tool 100 into a surrounding tubular (e.g., casing, liner, or the wellbore wall) of the wellbore, as at 702. At this point, the downhole tool 100 may be in a run-in configuration (e.g., as shown in FIG. 2A). As described above, the downhole tool 100 may include a mandrel 102 and a cone 120 having a tapered outer surface 130 and being received around the mandrel 102. The downhole tool 100 may also include a slips assembly 124 received around the mandrel 102 and positioned at least partially around the tapered outer surface 130 of the cone 120. The downhole tool 100 may further include a sealing ring 122 positioned around the tapered outer surface 130. The slips assembly 124 directly engages the sealing ring 122.

Once the downhole tool 100 is deployed to a desired depth in the wellbore, the method 700 may proceed to actuating the downhole tool 100 from the run-in configuration into a set configuration, as at 704. In an embodiment, actuating the downhole tool 100 may include pulling the mandrel 102 in an uphole direction, as at 706 and pushing the cone 120 in a downhole direction, as at 706. Pulling the mandrel 102 and pushing the cone 120 causes the slips assembly 124 to move the sealing ring 122 along the tapered outer surface 130 of the cone 120, thereby expanding the sealing ring 122 radially outward and into engagement with the surrounding tubular, as at 710.

In an embodiment, pulling the mandrel 102 and pushing the cone 120 causes the slips assembly 124 to expand radially outwards. Furthermore, actuating the downhole tool 100 from the run-in configuration into the set configuration causes the sealing ring 122 to form a metal-to-metal seal with the surrounding tubular. In some embodiments, the downhole tool 100 lacks a rubber sealing element that engages the surrounding tubular.

The sealing ring 122 may also include an outer surface 300 which may have a constant diameter. In such an embodiment, expanding the sealing ring 122 includes reducing a radial thickness of the sealing ring (e.g., the inner and outer diameters of the ring 122 may be increased, but the inner diameter may be increased more than the outer diameter).

In another embodiment, the outer surface 300 of the sealing ring 122 has two axially-separated peaks 404, 406 and a recessed section 402 between the two peaks 404, 406. In such an embodiment, expanding the sealing ring 122 may include deforming the two peaks 404, 406 as they engage the surrounding tubular.

In another embodiment, the sealing ring 122 is helical (either wound or with a helical cut or gap 500 formed therein). In such an embodiment, expanding the sealing ring 122 causes the sealing ring 122 to at least partially unwind.

In various embodiments, the sealing ring 122 may include a plurality of inserts 600. As such, expanding the sealing ring 122 may cause the plurality of inserts 600 to bite into the surrounding tubular.

Figure 8:
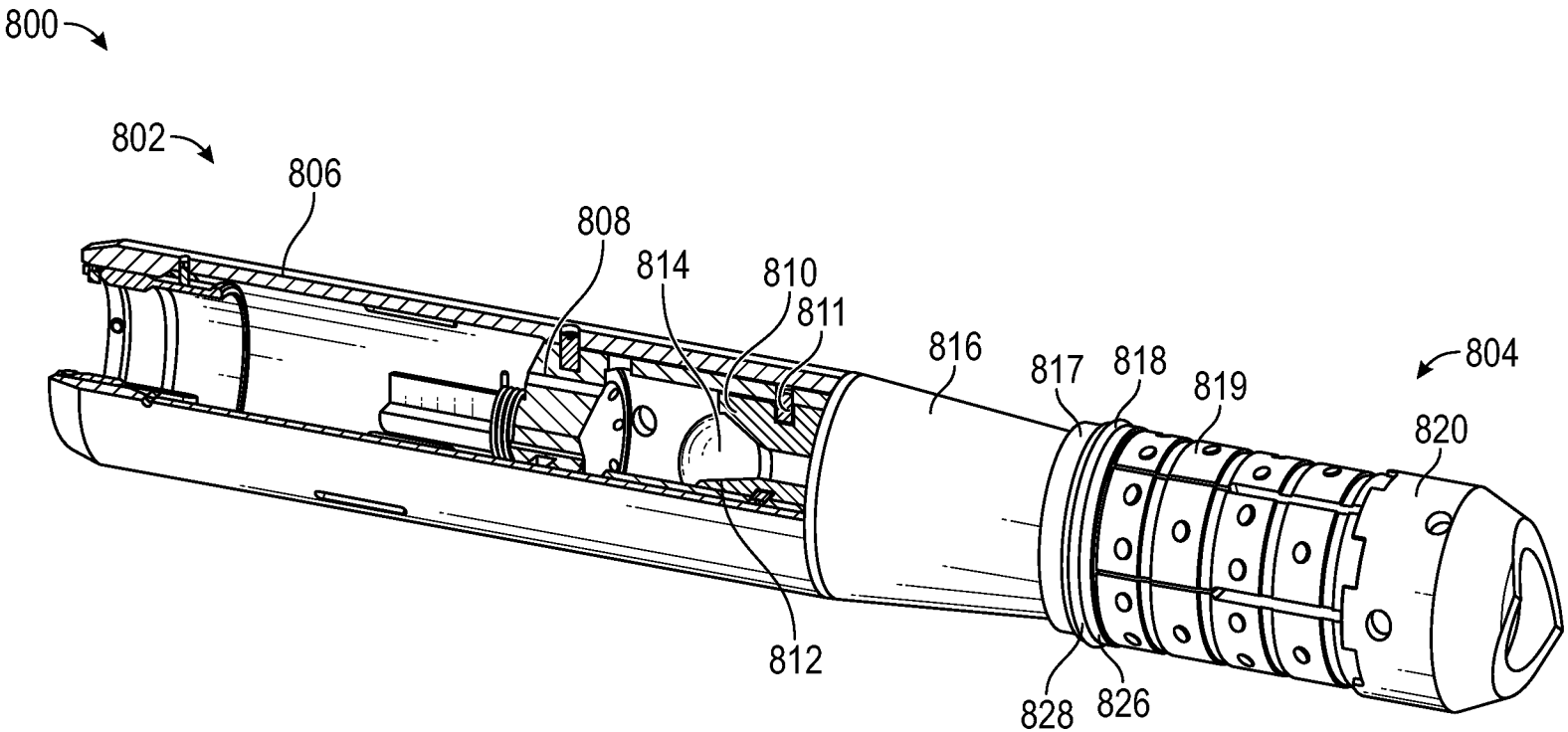
FIG. 8 illustrates a perspective view of a downhole assembly including a setting tool and a downhole tool, according to an embodiment.
Figure 9:
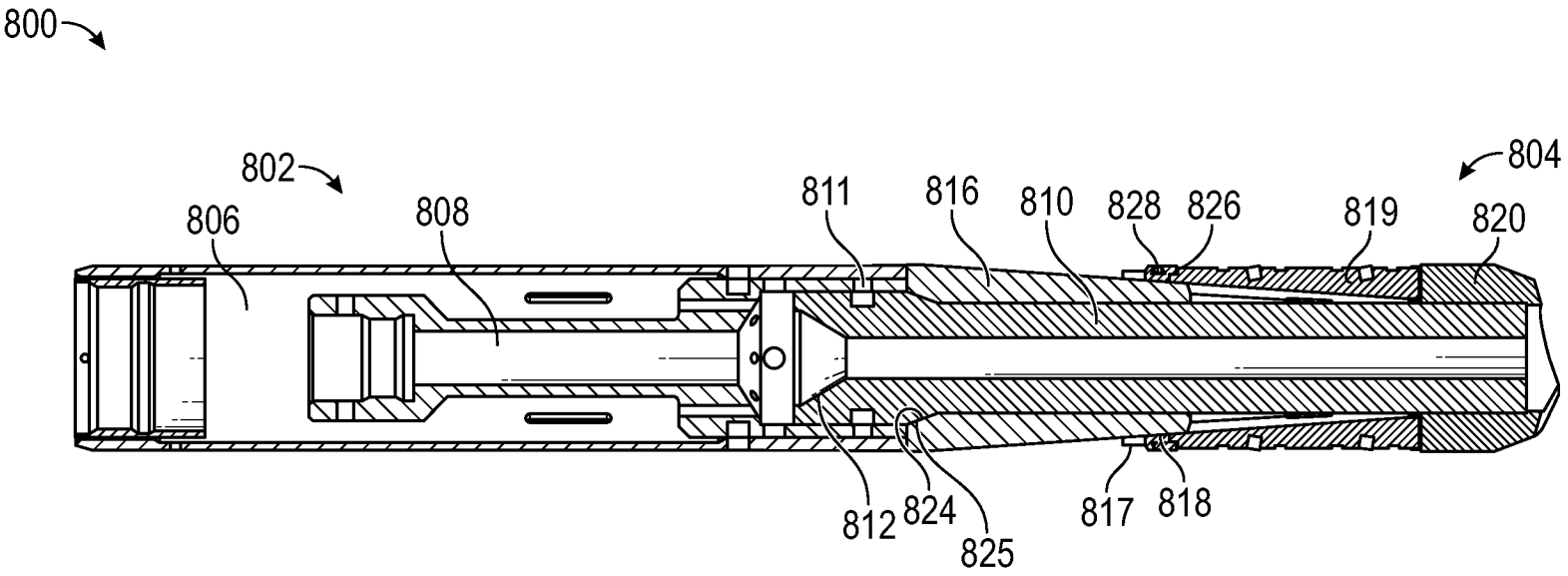
FIG. 9 illustrates a side, cross-sectional view of the downhole assembly of FIG. 8, according to an embodiment.

FIGS. 8 and 9 illustrate a side, cross-sectional view and a perspective, quarter-sectional view, respectively, of an assembly 800 including a setting tool 802 and a downhole tool 804, according to another embodiment. The setting tool 802 may be configured to set the downhole tool 804 in the well, and then may be released therefrom and withdrawn from the well, leaving the downhole tool 804 set in the well, as will be discussed in greater detail below.

The setting tool 802 generally includes a setting sleeve 806 and a setting rod 808 positioned at least partially within the setting sleeve 806. As shown, the setting rod 808 may be at least partially formed as a cylindrical sleeve, forming a hollow region 807 therein. The setting rod 808 and the setting sleeve 806 may be configured to slide relative to one another, e.g., by stroking a piston or in another manner in the well. The operation of the setting rod 808 and the setting sleeve 806 may be configured to impart a push-pull force coupling to the downhole tool 802, to set the downhole tool 802.

The downhole tool 804 may include a mandrel 810 that is connected to the setting rod 808 via a releasable connection made using, in a specific embodiment, shear pins 811. The mandrel 810 may be configured to remain in the well, while the setting tool 802 may be withdrawn from the downhole tool 804 and removed from the well subsequent to performing its setting function. Accordingly, the mandrel 810 may provide a seat 812, which may be configured to engage an obstructing member 814, e.g., a ball, as shown. The obstructing member 814, in some embodiments, may be deployed into the well along with the setting tool 802 and the downhole tool 804. In a specific embodiment, the obstructing member 814 may be contained within the setting rod 808, and axially between the seat 812 of the mandrel 810 and the setting rod 808.

The downhole tool 802 may also include a cone 816, an anti-seal ring 817, a sealing ring 818, and a slips assembly 819 positioned around the mandrel 810 and at least partially axially-adjacent to one another. In some embodiments, one or more other components may be interposed between any two of the components. A mule shoe 820 may be connected (e.g., threaded) to the mandrel 810 and positioned axially-adjacent to the slips assembly 819.

The cone 816 may have a tapered outer surface, which may be configured to wedge the anti-seal ring 817, sealing ring 818, and slips assembly 819 radially outwards when the cone 816 is advanced therein. Further, as shown in FIG. 9, the cone 816 may include an inner shoulder 824, which may engage a shoulder 825 formed on the mandrel 810. Accordingly, the cone 816, anti-seal ring 817, sealing ring 818, and slips assembly 819 may initially be entrained axially between upper end of the mandrel 810 and the mule shoe 820. The setting sleeve 806 may axially engage the cone 816, so as to apply an axial force (e.g., downward) that opposes an axial force applied by the setting rod 808 on the mandrel 810 (e.g., upward).

The sealing ring 818 may include a base 826 and a sealing element 828. The sealing element 828 may be, for example, a rubber material that is configured to form a seal with a surrounding tubular (e.g., casing) during setting. The base 826 may be formed from a base material that is stronger than (resists deformation in comparison to) the material of the sealing element 828, e.g., a plastic such as DELRIN® or a thermoplastic (e.g., PEEK), a fiber-wound or filament-wound carbon-fiber material (composite), magnesium alloy, another metal, or another material. In a specific embodiment, the base 826 may provide a groove or another structure for receiving and connecting to the sealing element 828. Further, the sealing ring 818 may include an undercut portion 830, which may receive an end of the slips assembly 819. As such, the sealing ring 818 may overlap the slips assembly 819, e.g., to prevent premature expansion of the slips assembly 819 during run-in.

The anti-seal ring 817 may have an annular structure with an outer diameter that is smaller than the outer diameter of the sealing ring 818. The anti-seal ring 817 may thus be configured to avoid interfering with a seal forming between the sealing ring 818 and the surrounding tubular. Further, the sealing ring 818 may be made of a material that is stronger (resists deformation in comparison to) the base material of the base 826. The anti-seal ring 817 may be, for example, made from a plastic, such as thermoplastics, e.g., PEEK, a metal such as magnesium alloy, a fiber-wound or filament-wound composite (carbon fiber-reinforced material), or another material. The sealing ring 818 may be axially between the slips assembly 819 and the anti-seal ring 817. The anti-seal ring 817 may thus be configured to hold the sealing ring 818 in place during run-in and prevent early sealing or partial sealing with the surrounding tubular.

During setting, the setting sleeve 806 may apply the downward axial force on the cone 816, while the setting rod 808 applies an upward axial force on the mandrel 810, which is transmitted to the mule shoe 820. This combination may axially compress the components of the downhole tool 804, thereby causing the cone 816 to advance axially into the slips assembly 819, such that the cone 816 is wedged between the mandrel 810 and the slips assembly 819. The cone 816, having a tapered outer surface, advancing may thus press the slips assembly 819 radially outwards. As this occurs, the slips assembly 819 presses against the sealing ring 818, which is also pressed radially outwards by the advancing cone 816. The sealing ring 818 in turn engages and presses axially against the anti-seal ring 817, which is also pressed radially outwards by the advancing cone 816. The sealing ring 818 and the slips assembly 819, at least, may eventually be pressed sufficiently far radially outward so as to engage a surrounding tubular (e.g., casing).

At this point, the connection between the mandrel 810 and the setting rod 808 may release, and the setting tool 802 may be withdrawn. The mandrel 810 may remain in the well and may remain connected to the mule shoe 820 in at least some embodiments. For example, the mandrel 810 may provide a bore through which fluid may flow and the seat 812 for the obstructing member 814, so as to block fluid communication through the downhole tool 804 in at least one axial direction (e.g., downhole) via the bore.

As used herein, the terms "inner" and "outer"; "up" and "down"; "upper" and "lower"; "upward" and "downward"; "above" and "below"; "inward" and "outward"; "uphole" and "downhole"; and other like terms as used herein refer to relative positions to one another and are not intended to denote a particular direction or spatial orientation. The terms "couple," "coupled," "connect," "connection," "connected," "in connection with," and "connecting" refer to "in direct connection with" or "in connection with via one or more intermediate elements or members."

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. An assembly, comprising:

a cone having a tapered outer surface;

a setting sleeve that engages the cone;

a slips assembly positioned at least partially around the tapered outer surface of the cone;

a mandrel received through the cone and the slips assembly, wherein the mandrel defines a seat therein, and a shoulder that engages an inner surface of the cone so as to transmit an axial force thereto;

a setting rod that engages the mandrel and is configured to release therefrom in response to the slips assembly anchoring into a surrounding tubular;

an obstructing member that is entrained between the setting rod and the mandrel during run-in, the obstructing member being configured to engage the seat of the mandrel, to block fluid communication through the mandrel;

a sealing ring positioned at least partially around the tapered outer surface of the cone, wherein the sealing ring comprises a base material and a sealing element coupled to the base material, and wherein the slips assembly directly engages the sealing ring, such that the slips assembly is configured to transmit a setting force to the sealing ring, which moves the sealing ring on the tapered outer surface of the cone and expands the sealing ring radially outward;

an anti-seal ring positioned adjacent to the sealing ring and around the cone, wherein the anti-seal ring is driven along the tapered outer surface of the cone by engagement with the sealing ring; and a mule shoe coupled to the mandrel and configured to press axially against the slips assembly, to move the slips assembly, the sealing ring, and the anti-seal ring axially with respect to the cone.

2. The assembly of claim 1, wherein the anti-seal ring has a smaller outer diameter than the sealing ring.

3. The assembly of claim 1, wherein the sealing ring is axially between the anti-seal ring and the slips assembly.

4. The assembly of claim 1, wherein the anti-seal ring is made of a material that is stronger than the base material.

5. The assembly of claim 1, wherein the mule shoe and the mandrel are not disconnected during setting.

6. The assembly of claim 1, wherein the sealing ring overlaps an end of the slips assembly, to prevent early expansion of the slips assembly.

7. The assembly of claim 1, wherein the base material comprises a groove that extends radially-inward from the outer surface thereof, and wherein the sealing element is positioned within the groove.

8. The assembly of claim 1, wherein the sealing element is not in contact with the slips assembly or the anti-seal ring.

9. An assembly, comprising:

a setting rod;

a setting sleeve positioned around the setting rod;

a mandrel coupled to the setting rod and defining a seat;

a cone having a tapered outer surface, positioned around the mandrel, and in axial engagement with the setting sleeve, wherein the mandrel defines a shoulder that engages an inner surface of the cone so as to transmit an axial force thereto;

a slips assembly positioned around the cone, wherein the cone advancing into the slips assembly presses the slips assembly radially outward, and wherein the setting rod is configured to release from the mandrel in response to the slips assembly anchoring into a surrounding tubular;

a sealing ring positioned around the cone and in axial engagement with the slips assembly, such that advancing the cone into the slips assembly causes the slips assembly to apply an axial force to the sealing ring, wherein advancing the cone into the slips assembly also advances the cone axially through the sealing ring and presses the sealing ring radially outward, wherein the sealing ring comprises a base material and a sealing element;

an anti-seal ring positioned around the cone and axially adjacent to the sealing ring, such that the sealing ring is axially between the anti-seal ring and the slips assembly; and an obstructing member that is entrained between the setting rod and the mandrel during run-in, the obstructing member being configured to engage the seat of the mandrel, to block fluid communication through the mandrel.

10. The assembly of claim 9, wherein the anti-seal ring is made of a stronger material than the base material of the sealing ring.

11. The assembly of claim 10, wherein the sealing ring comprises an elastomeric sealing element that is coupled to the base material of the sealing ring.

12. The assembly of claim 9, wherein the sealing ring overlaps an end of the slips assembly.

13. The assembly of claim 9, further comprising a mule shoe coupled to the mandrel and in axial engagement with the slips assembly, such that an axial force on the mandrel is transmitted to the slips assembly via the mule shoe.

14. The assembly of claim 13, wherein the slips assembly is positioned axially between the sealing ring and the mule shoe, and wherein the mandrel and the mule shoe are not disconnected by advancing the cone into the slips assembly to set the slips assembly.

15. The assembly of claim 9, wherein the setting sleeve and the setting rod are configured to be released from engagement with the cone and the mandrel, respectively, and to be withdrawn from a wellbore.

16. The assembly of claim 9, wherein the obstructing member is configured to be caught in the seat of the mandrel, to block fluid flow in an axial direction through the mandrel.

17. The assembly of claim 16, wherein the obstructing member is positioned within the setting rod.

18. A downhole tool, comprising:

a cone having a tapered outer surface;

a slips assembly positioned at least partially around the tapered outer surface of the cone;

a sealing ring positioned at least partially around the tapered outer surface of the cone, wherein the slips assembly directly engages the sealing ring, such that the slips assembly is configured to transmit a setting force onto the sealing ring, which moves the sealing ring on the tapered outer surface of the cone and expands the sealing ring radially outward, wherein the sealing ring comprises a base material and a sealing element;

a mule shoe axially engaging the sealing ring;

a mandrel extending through the cone, the slips assembly, and the sealing ring and connected to the mule shoe, wherein the mandrel defines a shoulder that engages an inner surface of the cone so as to transmit an axial force thereto;

a setting rod coupled to the mandrel;

an obstructing member positioned at least partially within the setting rod; and an anti-seal ring positioned adjacent to the sealing ring and around the cone, wherein the anti-seal ring is driven along the tapered outer surface of the cone by engagement with the sealing ring.

19. The downhole tool of claim 18, wherein the mandrel comprises a seat configured to receive the obstructing member so as to prevent fluid communication in at least one axial direction though the tool.

* * * * *